US009964301B2

(12) United States Patent
Lankinen et al.

(10) Patent No.: US 9,964,301 B2
(45) Date of Patent: May 8, 2018

(54) FLUIDIZED BED BOILER WITH A SUPPORT CONSTRUCTION FOR A PARTICLE SEPARATOR

(71) Applicant: Sumitomo SHI FW Energia Oy, Espoo (FI)

(72) Inventors: Pentti Lankinen, Varkaus (FI); Veli-Matti Hiltunen, Leppävirta (FI)

(73) Assignee: Sumitomo SHI FW Energia Oy, Espoo (FI)

( * ) Notice: Subject to any disclaimer, the term of this patent is extended or adjusted under 35 U.S.C. 154(b) by 133 days.

(21) Appl. No.: 14/891,712

(22) PCT Filed: May 27, 2015

(86) PCT No.: PCT/FI2015/050364

§ 371 (c)(1),
(2) Date: Nov. 17, 2015

(87) PCT Pub. No.: WO2015/185796

PCT Pub. Date: Dec. 10, 2015

(65) Prior Publication Data

US 2016/0123574 A1 May 5, 2016

(30) Foreign Application Priority Data

Jun. 3, 2014 (FI) ..... 20145506

(51) Int. Cl.
*F22B 31/00* (2006.01)
*F22B 37/24* (2006.01)
(Continued)

(52) U.S. Cl.
CPC ..... *F22B 31/0015* (2013.01); *F22B 31/0007* (2013.01); *F22B 31/0084* (2013.01);
(Continued)

(58) Field of Classification Search
CPC .... F22B 37/242; F22B 37/24; F22B 31/0007; F22B 31/0084; F22B 31/0015;
(Continued)

(56) References Cited

U.S. PATENT DOCUMENTS 3,280,800 A 10/1966 Sullivan
3,811,415 A * 5/1974 Lawrence ..... F22B 37/201 122/478
(Continued)

FOREIGN PATENT DOCUMENTS

EP 0 760 071 B1 10/1997
JP H05-99402 A 4/1993
(Continued)

OTHER PUBLICATIONS

Finnish Office Action dated Dec. 17, 2014, issued in counterpart Finnish Patent Application No. 20145506.
(Continued)

*Primary Examiner* — Kenneth Rinehart
*Assistant Examiner* — Raymond Williamson
(74) *Attorney, Agent, or Firm* — Fitzpatrick, Cella, Harper & Scinto

(57) ABSTRACT

A fluidized bed boiler with a support construction for a particle separator. The fluidized bed boiler includes a bottom-supported furnace in which at least one particle separator with a support construction is in gas flow connection with an upper portion of the furnace and includes a furnace side portion, an outer portion opposite to the furnace side portion, and a conical lower portion. At least two bottom-supported downcomer pipes are in fluid connection with a steam drum and adjacent to the outer portion of the particle separator. The support construction includes a frame-like supporting member surrounding at least a portion of the conical lower portion, and an outboard portion of the supporting member is attached to the at least two downcomer pipes to support the at last one particle separator.

16 Claims, 6 Drawing Sheets

(51) Int. Cl.
*F23C 10/10* (2006.01)
*F22B 37/20* (2006.01)

(52) U.S. Cl.
CPC ..... *F22B 37/207* (2013.01); *F22B 37/24* (2013.01); *F22B 37/242* (2013.01); *F23C 10/10* (2013.01)

(58) Field of Classification Search
CPC ..... F23C 10/00; F23C 10/08; F23C 10/04; F23C 10/02; F23C 10/10
USPC ..... 110/243, 244, 245, 234; 122/510
See application file for complete search history.

(56) References Cited

U.S. PATENT DOCUMENTS 4,419,940 A 12/1983 Cosar et al.
5,460,127 A * 10/1995 Nordenberg ..... F22B 31/045 110/245
6,039,008 A 3/2000 Anderson et al.
2010/0024694 A1* 2/2010 Lankinen ..... F22B 31/0007 110/216
2010/0037805 A1* 2/2010 Itapelto ..... B01J 8/0015 110/186

FOREIGN PATENT DOCUMENTS

WO 95/33159 A1 12/1995
WO 2007/135238 A2 11/2007

OTHER PUBLICATIONS

Finnish Patent and Registration Office Search Report dated Dec. 17, 2014, issued in counterpart Finnish Patent Application No. 20145506.
Notification of and International Search Report and Written Opinion dated Sep. 28, 2015, in counterpart International Application No. PCT/FI2015/050364.
Notification of and International Preliminary Report on Patentability and Written Opinion dated Dec. 6, 2016, in corresponding International Patent Application No. PCT/FI2015/050364.

* cited by examiner

FLUIDIZED BED BOILER WITH A SUPPORT CONSTRUCTION FOR A PARTICLE SEPARATOR

CLAIM OF PRIORITY

This application is a U.S. national stage application of PCT International Application No. PCT/FI2015/050364, filed May 27, 2015, which claims priority from Finnish patent application number 20145506, filed Jun. 3, 2014.

BACKGROUND OF THE INVENTION

Field of the Invention

The present invention relates to a bottom-supported fluidized bed boiler with a support construction for a particle separator. More particularly, the invention relates to a fluidized bed boiler comprising a bottom-supported furnace, at least one particle separator with a support construction in gas flow connection with an upper portion of the furnace and comprising a furnace side portion, an outer portion opposite to the furnace side portion and a conical lower portion, and at least two bottom-supported downcomer pipes in fluid connection with a steam drum and adjacent to the outer portion of the particle separator.

Description of Related Art

Fluidized bed boilers comprise a furnace for combusting fuel and at least one discharge channel connected to an upper portion of the furnace for discharging flue gas and solid particles from the furnace. Solid particles are generally separated from the flue gas in a particle separator so as to return at least a portion of the particles via a return channel to a lower portion of the furnace. The return channel is often provided with a heat exchange chamber for recovering heat from the separated particles.

Particle separators used in the fluidized bed boilers are generally cyclone separators having a cylindrical upper portion and a conical lower portion. According to a conventional construction, the cylindrical upper portion has a circular crosssection, but during the last two decades, polygonal cross sections, such as square or octagonal cross sections, have become more and more common. Correspondingly, the cross section of the conical lower portion can vary from circular to different polygonal shapes.

Relatively large fluidized bed boilers are generally arranged to be top-supported, i.e., so that the furnace and particle separator (or particle separators) are arranged to hang from a rigid supporting structure. Relatively small fluidized bed boilers may alternatively be arranged to be bottom-supported. The main difference between the top-supported and bottom-supported construction is that when the boiler heats up to its operating temperature, the thermal expansion of a top-supported boiler takes place mainly downwards, whereas in a bottom-supported boiler, the thermal expansion takes place mainly upwards. Bottom supported boilers are generally simpler and economically more advantageous than top-supported boilers, especially in the case of small fluidized bed boilers, because they do not require a separate supporting structure. A disadvantage of bottom-supported construction is that the walls have to be strong enough to carry the compression load of the structures above.

A special problem in bottom-supported fluidized bed boilers is the supporting of the particle separator. Because the bottom of the particle separator is generally at a higher level than the bottom of the furnace, the bottom of the particle separator is, according to a conventional solution, supported by a special support leg to the ground or founding of the boiler plant.

Published European Patent Document EP 760071 B1 discloses a bottom-supported circulating fluidized bed boiler comprising a steam drum on top of two bottom-supported downcomer pipes and a cooled rectangular cyclone separator having a common wall with the furnace and an opposite wall, or front wall, connected to the downcomer pipes. A disadvantage of this construction is that the common wall of the two units, i.e., of the furnace and the separator, has to be made especially strong to carry a large portion of the weights of both units.

Published International Patent Document WO 2007/135238 A2 discloses a top-supported circulating fluidized bed boiler comprising a particle separator hanging from a supporting structure by the aid of a frame connected to the upper portion of the separator.

An object of the present invention is to provide a bottom-supported fluidized bed boiler with a simple and a reliable means for supporting the particle separator.

SUMMARY OF THE INVENTION

According to one aspect, the present invention provides a fluidized bed boiler with a support construction for a particle separator, comprising a bottom-supported furnace, at least one particle separator with a support construction in gas flow connection with an upper portion of the furnace and comprising a furnace side portion, an outer portion opposite to the furnace side portion and a conical lower portion, and at least two bottom-supported downcomer pipes in fluid connection with a steam drum and adjacent to the outer portion of the particle separator. It is characteristic to the invention that the support construction comprises a frame-like supporting member surrounding at least a portion of the conical lower portion, wherein an outboard portion of the supporting member is attached to the at least two downcomer pipes to support the at least one particle separator.

The present invention provides a new solution for supporting the particle separator of a bottom-supported fluidized bed boiler by arranging a frame-like supporting member to surround the conical lower portion of the particle separator and attaching the outboard portion of the supporting member to bottom-supported downcomer pipes. The invention provides a simple and an economically advantageous fluidized bed boiler in which the particle separator can be installed relatively quickly and easily. There is no need to have a common wall of the separator and the furnace, or to provide a special support leg between the bottom of the particle separator and the ground, or the founding, of the boiler.

According to an embodiment of the present invention, the frame-like supporting member is a closed frame that is arranged to encircle the conical lower portion of the particle separator. According to another embodiment, the supporting member is not closed, whereby it only partially encircles the conical lower portion. The term outboard portion of the supporting member refers to a portion, or half, of the supporting member, which is located farthest away from the furnace. Opposite to the outboard portion is the inboard portion, which refers to a portion, or half, of the supporting member, which is located nearest to the furnace.

The internal cross section of, or the cross section within, the frame-like supporting member corresponds advantageously to an external cross section of the conical lower portion of the particle separator. Thereby, the particle separator can be lowered during the installation thereof on the supporting member in such a way that the conical lower portion fits to the supporting member. If, for example, the cross section of the conical lower portion is of an octagonal shape, the frame-like supporting member may also have an octagonal cross section. Alternatively, the frame-like supporting member may have an internal cross section that is to be arranged in contact with only a portion of an external cross section of the conical lower portion of the particle separator. For example, even if the conical lower portion is of an octagonal shape, the frame-like supporting member may have an internal cross section of a square, which thus is to be arranged to be in contact with only every second of the slanted plates of the octagonal lower portion.

According to a preferred embodiment of the present invention, an inboard portion of the supporting member is attached to a side wall of the furnace. Thereby, the supporting member is advantageously a closed frame with an outboard portion connected to at least two downcomer pipes and an inboard portion attached to the side wall of the furnace. The supporting member advantageously extends substantially horizontally from the at least two downcomer pipes to the side wall of the furnace. Thus, the supporting member is attached to the side wall of the furnace at the horizontal level of the conical lower portion of the particle separator. Because the conical lower portion of the particle separator is in practice located at the vertical level of an intermediate portion of the furnace wall, a portion of the weight of the particle separator is, according to the embodiment, carried only by a lower portion of the side wall of the furnace. Therefore, only the lower portion of the side wall has to be made strong enough to carry additional weight. Because the supporting member is attached to the side wall of the furnace and to at least two downcomer pipes, a very stable support of the particle separator is provided.

The boiler system advantageously comprises at least two full height vertical downcomer pipes adjacent to the outer portion of the particle separator, extending from the steam drum to the ground or founding of the plant. In addition to the full height downcomer pipes adjacent to the outer portion of the particle separator, each of the at least two downcomer pipes may also comprise a bottom-supported additional branch adjacent to the furnace side portion of the particle separator. Each of the additional branches is in fluid connection with the corresponding full height downcomer pipe by a horizontally extending pipe section.

According to a preferred embodiment of the present invention, the inboard portion of the supporting member is attached to at least two additional branches of the at least two downcomer pipes. The particle separator is thereby supported by fixing the supporting member to the two full height downcomer pipes and to the two additional branches. Thus, the supporting member does not have to be attached to a side wall of the furnace in a way to carry the weight of the particle separator by the side wall.

According to an alternative construction, the full height downcomer pipes are arranged adjacent to the furnace side portion of the particle separator and the additional downcomer pipe branches are arranged adjacent to the outer portion of the particle separator. When using any of the two above-mentioned embodiments, the weight of the particle separator impacting on the side wall of the furnace is minimized, while a very stable support system of the particle separator is provided.

When the fluidized bed boiler comprises only one particle separator, the particle separator is advantageously supported by two full height downcomer pipes, as described above. In a case when the boiler comprises two particle separators, side by side, there are advantageously at least three downcomer pipes side by side, so that each particle separator can be supported by a pair of downcomer pipes in one of the ways described above. When using three full height downcomer pipes to support two particle separators, one of the downcomer pipes is advantageously arranged between the outer portions of the two particle separators, to carry the weight of both separators. Correspondingly, if there are three particle separators side by side, there has to be at least four downcomer pipes. Naturally, it is also possible to arrange 2N full height downcomer pipes to support N separators, whereby each separator can be supported as in the case of one separator, as described above.

The fluidized bed boiler is usually a circulating fluidized bed boiler, but it may also be a bubbling bed boiler comprising a particle separator.

The above brief description, as well as further objects, features, and advantages of the present invention will be more fully appreciated by reference to the following detailed description of the currently preferred, but nonetheless illustrative, embodiments in accordance with the present invention, when taken in conjunction with the accompanying drawings.

DETAILED DESCRIPTION OF THE INVENTION

Figure 1:
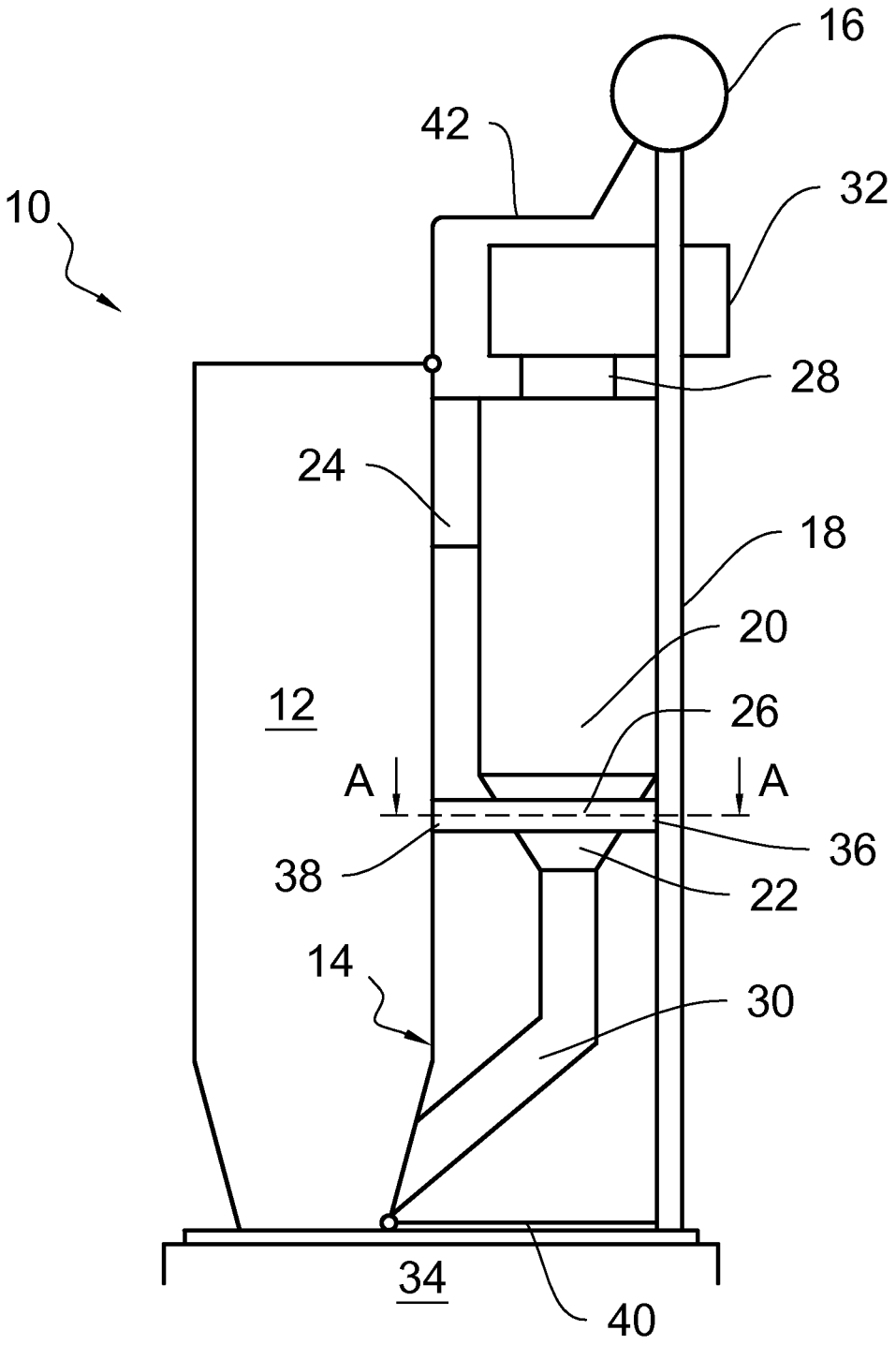
FIG. 1 schematically illustrates a side view of a fluidized bed boiler with a supporting member for a particle separator according to a preferred embodiment of the present invention.

The schematic diagram of FIG. 1 illustrates a side view of a bottom-supported circulating fluidized bed boiler 10 arranged on a support foundation 34 made of, for example, concrete or steel. In the following description, it is assumed that thermal expansion of the boiler is entirely upwards, even if, in practice, there is also thermal expansion in the horizontal direction, which is generally taken into account by a suitable sliding support system.

The boiler 10 comprises a furnace 12 having a side wall 14, which may also be called a rear wall, a particle separator 20 located at the rear wall side of the furnace 12, a discharge conduit 24 for conveying flue gas and entrained particles from the upper portion of the furnace 12 to the particle separator 20, and conventional bottom-supported downcomer pipes 18 adjacent to an outer portion of the particle separator 20, in fluid connection with a steam drum 16. In practice, the boiler 10 also comprises other units, such as means for heat recovery and flue gas cleaning, which are not shown in FIG. 1, because they are not essential for the present invention.

The steam drum 16 is advantageously arranged on top of the downcomer pipes 18 to be supported by the downcomer pipes 18. Water pipes 40 convey hot water from the lower portion of the downcomer pipes 18 to an upstream end of evaporation tubes on the side walls 14 of the furnace 12, and steam pipes 42 convey a mixture of steam and water from a downstream end of the evaporation tubes to the steam drum 16. Due to the circulating water, the thermal expansion of the downcomer pipes 18 is nearly as large as that of the side walls of the furnace 12.

The particle separator 20 may be, for example, a cyclone separator formed of water or steam cooled panels. The particle separator 20 comprises a discharge duct 28 for conveying cleaned flue gas to a flue gas duct 32 and a return channel 30 for returning separated particles to a lower portion of the furnace 12. The return channel 30 may comprise a heat exchange chamber, not shown in FIG. 1, for cooling the separated particles. The return channel 30 is connected to a conical lower portion 22 of the particle separator 20, which conical lower portion 22 is enclosed by an enclosure wall or enclosure walls, which is/are inclined, so that the cross section of the particle separator 20 decreases in the conical lower portion 22 towards the foundation 34 of the boiler 10.

Figure 2A:
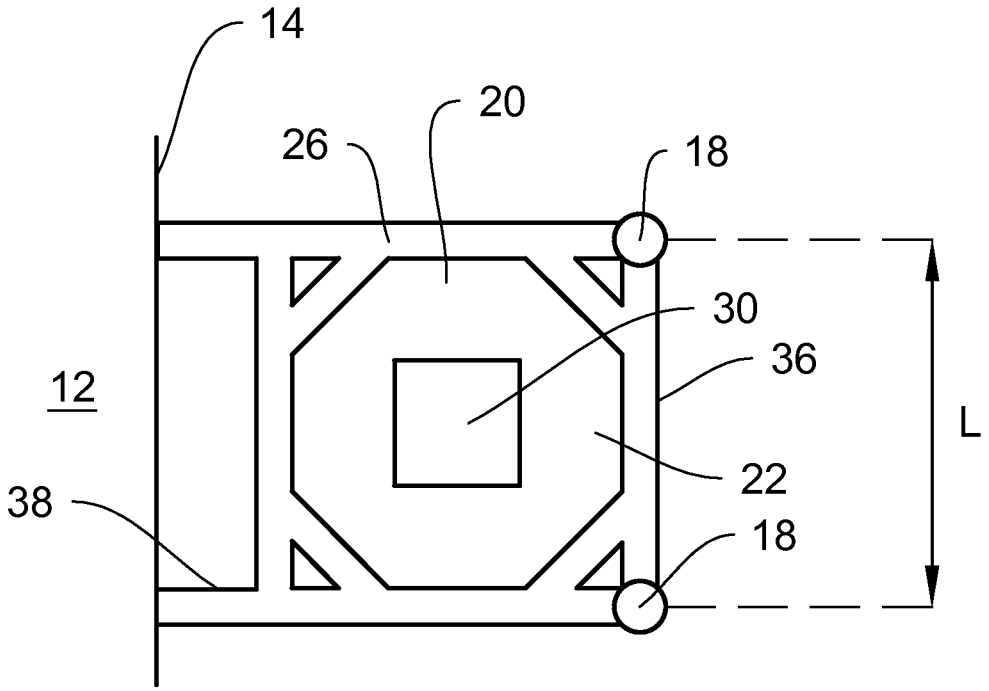
FIG. 2*a* schematically illustrates a cross-sectional view A-A of the supporting member of FIG. 1 according to an embodiment of the present invention.
Figure 2B:
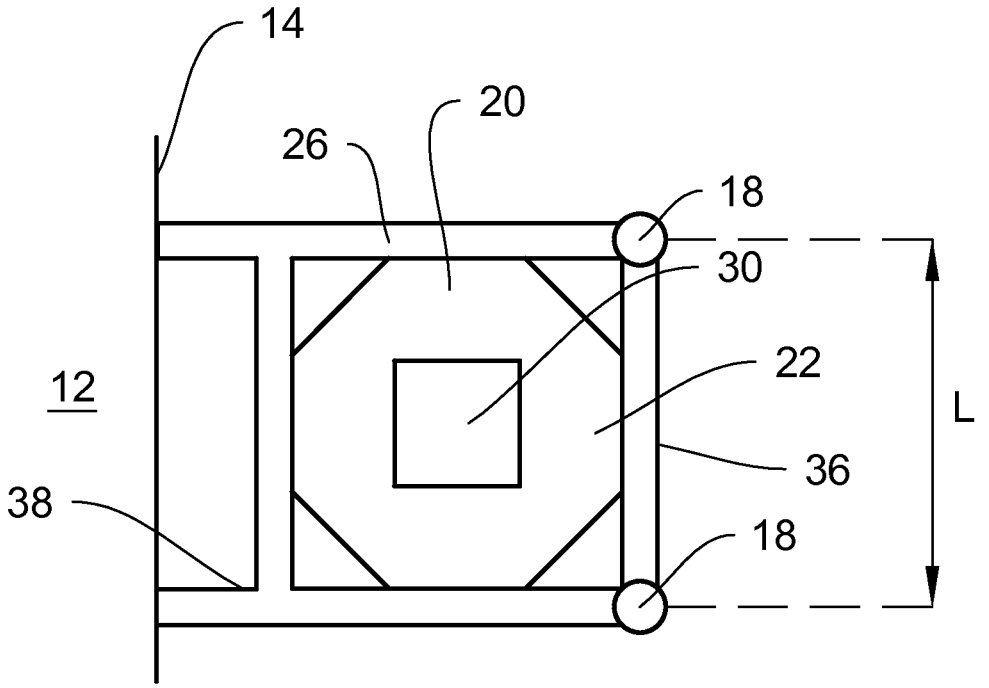
FIG. 2*b* schematically illustrates a cross-sectional view A-A of the supporting member of FIG. 1 according to another embodiment of the present invention.

The particle separator 20 is resting on a frame-like supporting member 26 surrounding the conical lower portion 22 of the particle separator 20. An outboard portion 36 of the supporting member 26 is attached to the downcomer pipe 18, or actually, as can be seen in FIG. 2*a* or 2*b*, to two downcomer pipes, to support the particle separator 20. An inboard portion 38 of the supporting member 26 is attached to the rear wall 14 of the furnace 12, so as to provide a stable support for the particle separator 20.

FIG. 2*a* schematically shows a cross-sectional view A-A of FIG. 1, i.e., a top view of a horizontal cross section at the level of the conical lower portion 22 of the particle separator 20. More specifically, FIG. 2*a* shows the supporting arrangement, with the supporting member 26, of the particle separator 20 in accordance with an embodiment of the present invention. In the embodiment of FIG. 2*a*, the horizontal cross section of the conical lower portion 22 of the particle separator 20 is octagonal. In practice, however, many other shapes, such as a circular or rectangular shape, of the cross section of the conical lower portion 22 of the particle separator 20, are also possible.

As shown in FIG. 2*a*, the outboard portion 36 of the supporting member 26 is attached to two downcomer pipes 18 and the inboard portion 38 of the supporting member 26 is attached to the wall 14 of the furnace 12. The supporting member 26 is a closed frame having an octagonal cross section corresponding to an octagonal cross section of the conical lower portion 22 of the particle separator 20. As can be seen in FIG. 2*a*, the octagonal shape is formed by beveling the corners of a square frame. Naturally, if the particle separator 20 is, for example, hexagonal, the corners of the main square frame should be beveled in a different way to achieve a hexagonal frame. The supporting construction is very rigid and stable.

According to FIG. 2*a*, the horizontal distance L between the downcomer pipes 18 nearly corresponds to a diameter of the bottom portion 22 of the particle separator 20 at the horizontal level of the supporting member 26, but, in practice, it can also be larger than the diameter by connecting the supporting member, or frame, 26 to the downcomer pipes 18 by a suitable support construction.

FIG. 2*b* schematically shows a cross-sectional view A-A of FIG. 1 according to another embodiment of the invention. Again, the particle separator 20, at least the conical lower portion 22 thereof, has an octagonal cross section. In this embodiment, however, the supporting member 26 is a frame having a substantially square shape into which the particle separator 20 can be supported. The supporting frame has four supporting beams to match with every second wall of the conical lower portion 22 of the particle separator 20. Hence, four walls of the conical lower portion 22 are in contact with the supporting member 26. In other words, the corners of the main square frame are not beveled, as is shown in FIG. 2*a*.

Figure 3:
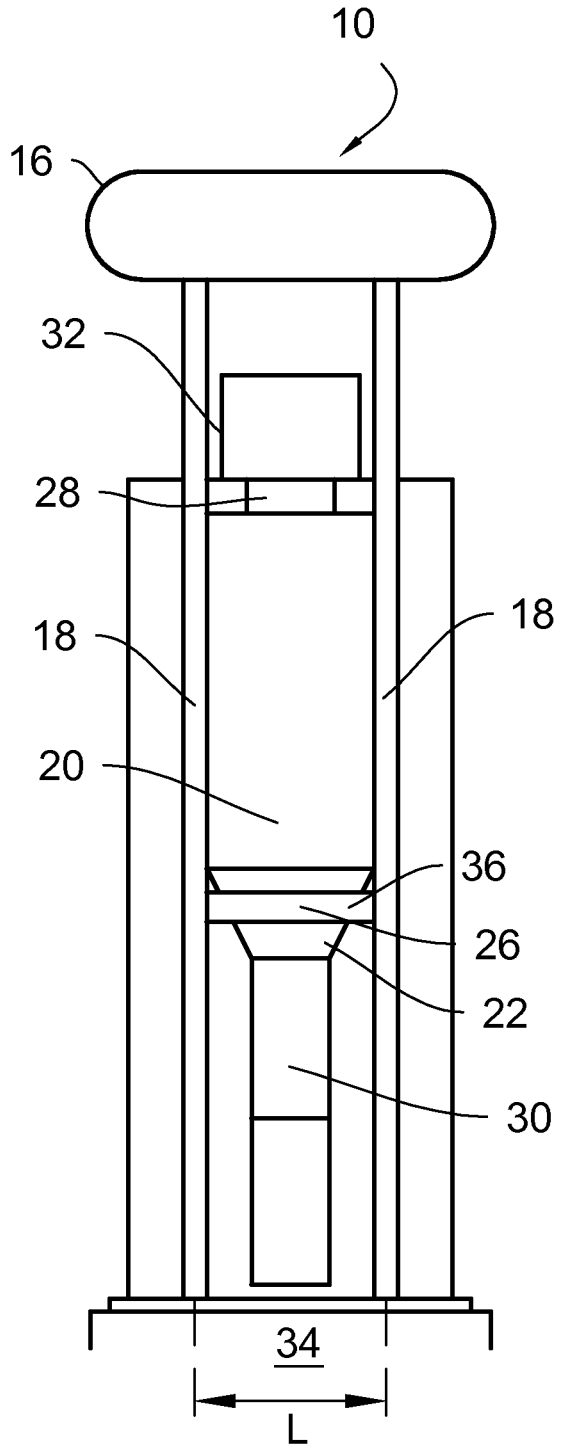
FIG. 3 schematically illustrates a rear view of the fluidized bed boiler in accordance with FIG. 1.

FIG. 3 shows a rear view of the fluidized bed boiler 10 in accordance with FIG. 1. FIG. 3 shows the particle separator 20 between two downcomer pipes 18. As discussed earlier, the horizontal distance L between the downcomer pipes 18 can be larger than the diameter of the particle separator 20, for example, to make it easier to arrange the separator 20 between the downcomer pipes 18. FIG. 3 shows a steam drum 16 in flow connection with two downcomer pipes 18, which downcomer pipes 18 extend from a supporting foundation 34 to the steam drum 16. Similarly, as shown in FIGS. 2*a* and 2*b*, the supporting member 26 is connected to the downcomer pipes 18. More specifically, the outboard portion 36 of the supporting member 26 is connected to two downcomer pipes 18 to support the particle separator 20 and the inboard portion 38 of the supporting member 26 is attached to the rear wall 14 of the furnace 12, as shown in FIG. 1.

Figure 4:
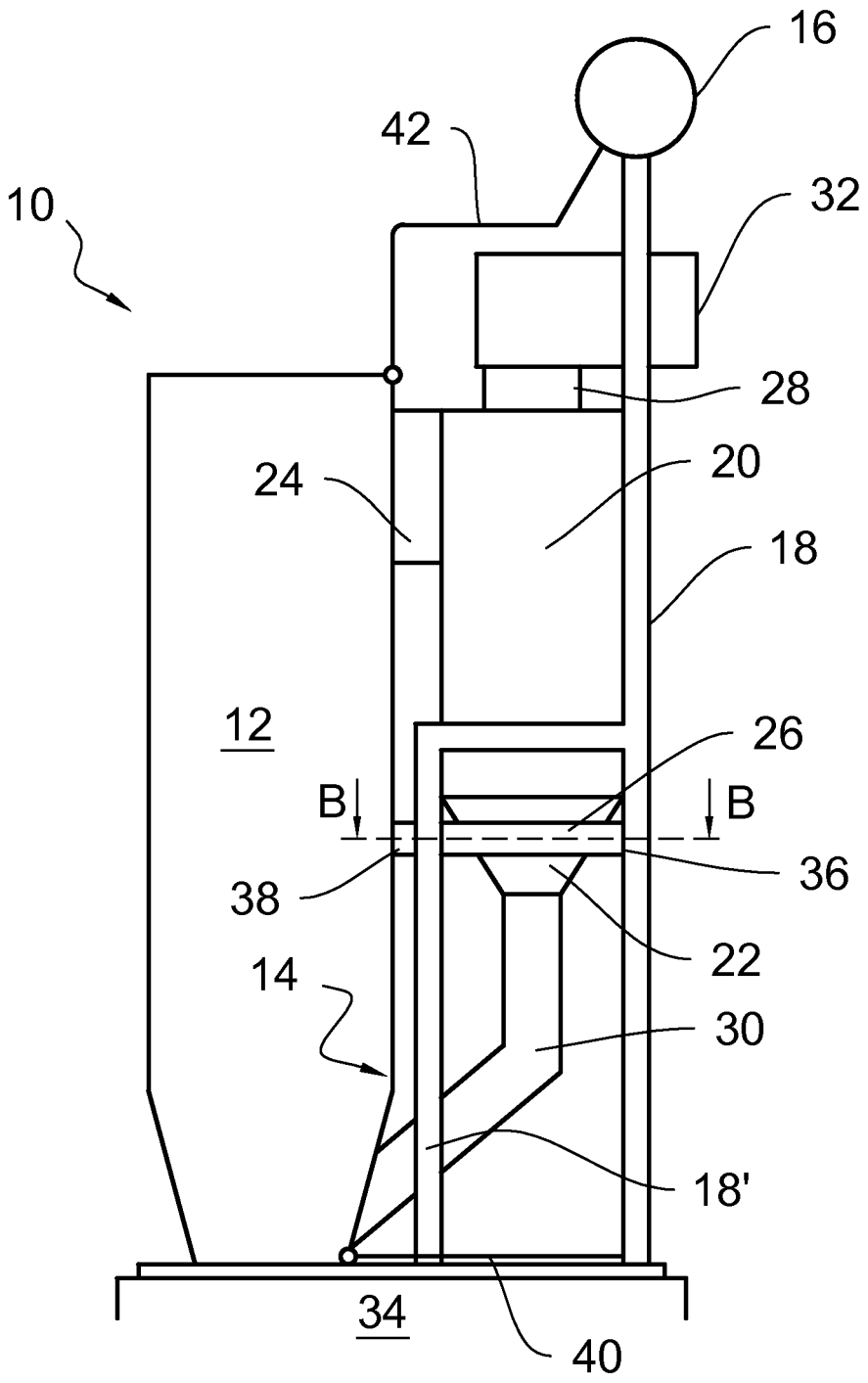
FIG. 4 schematically illustrates a sectional side view of a fluidized bed boiler with another supporting construction for the particle separator.

The diagram of FIG. 4 schematically shows a side view of another bottom-supported circulating fluidized bed boiler 10 in accordance with the present invention. The boiler 10 shown here differs from that shown in FIG. 1 in that each of the full height downcomer pipes 18 adjacent to the outer portion of the particle separator 20 is connected to a mainly vertical, bottom-supported additional branch 18' of the downcomer pipe 18, adjacent to the furnace side portion of the particle separator 20. The additional branch 18' is in fluid connection with the corresponding full height downcomer pipes 18 by a horizontally extending pipe section. The inboard portion 38 of the supporting member 26 is attached to the additional branches 18' of the downcomer pipes 18 to provide further vertical support to the particle separator 20.

An important advantage of this embodiment is that the load of the particle separator 20 does not affect the furnace wall 14 in a similar manner as in the embodiment shown in FIG. 1. Even though the frame-like supporting member 26 is in a vertical direction supported by the additional downcomer pipes 18', the supporting member 26 may extend to the rear wall 14 of the furnace 12 to increase the rigidity of the construction in the horizontal direction. However, according to the embodiment of FIG. 4, the weight of the particle separator 20 is divided by the aid of the supporting member 26 to the downcomer pipes 18 and their additional branches 18'.

According to the embodiment shown in FIG. 4, straight, full height downcomer pipes 18 are arranged adjacent to the outer portion of the particle separator 20 and their additional branches 18' are arranged adjacent to the furnace side portion of the particle separator 20. According to another embodiment of the present invention, the full height downcomer pipes 18 may alternatively be arranged adjacent the furnace side portion of the particle separator 20, and the additional downcomer branches are correspondingly arranged adjacent to the outer portion of the particle separator 20. Thereby, the inboard portion 38 of the supporting member 26 is attached to the full height, straight portions of the downcomer pipes 18, and the outboard portion of the supporting member 26 is attached to the additional portions, or branches, of the downcomer pipes 18.

Figure 5:
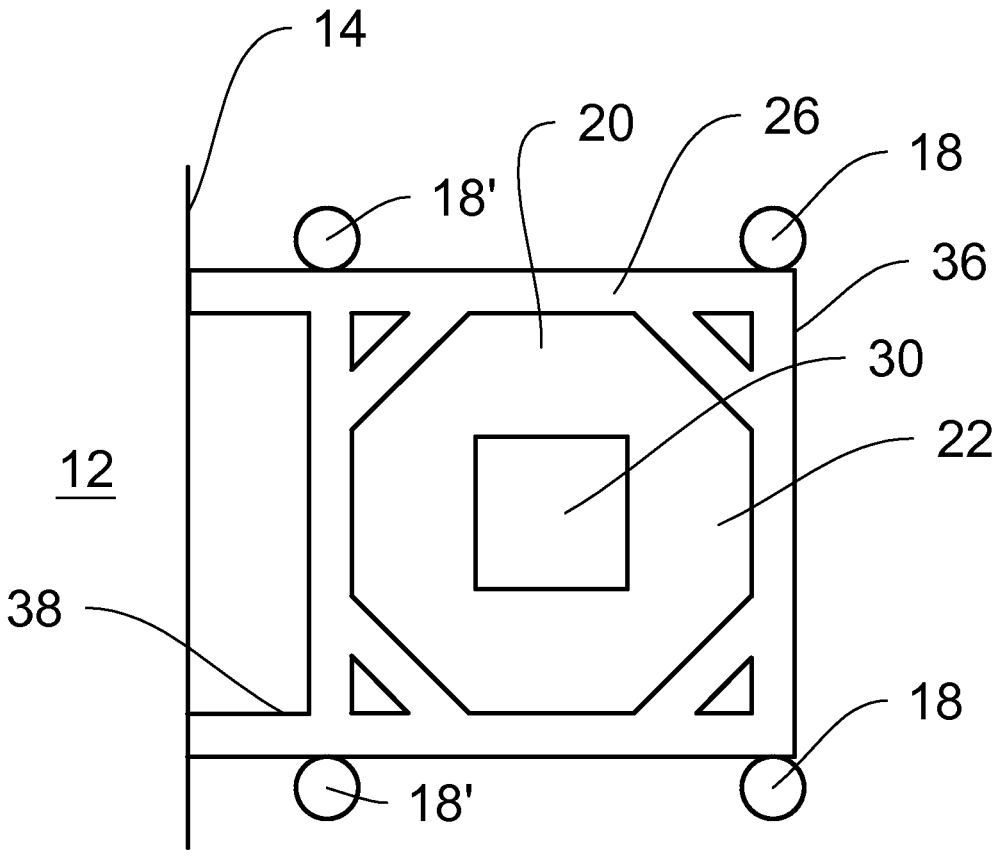
FIG. 5 schematically illustrates a cross-sectional view B-B from the top of the supporting member of FIG. 4 according to an embodiment of the present invention.

FIG. 5 schematically shows a cross-sectional top view B-B of FIG. 4. The outboard portion 36 of the supporting member 26 is connected to two down-comer pipes 18 and the inboard portion 38 of the supporting member 26 is connected to two additional branches 18' of the downcomer pipes and to the rear wall 14 of the furnace 12. The connections between the supporting member 26 and the downcomer pipes 18 and the wall 14 can be performed by any conventional means, such as by welding or by mechanical fixing elements.

Figure 6:
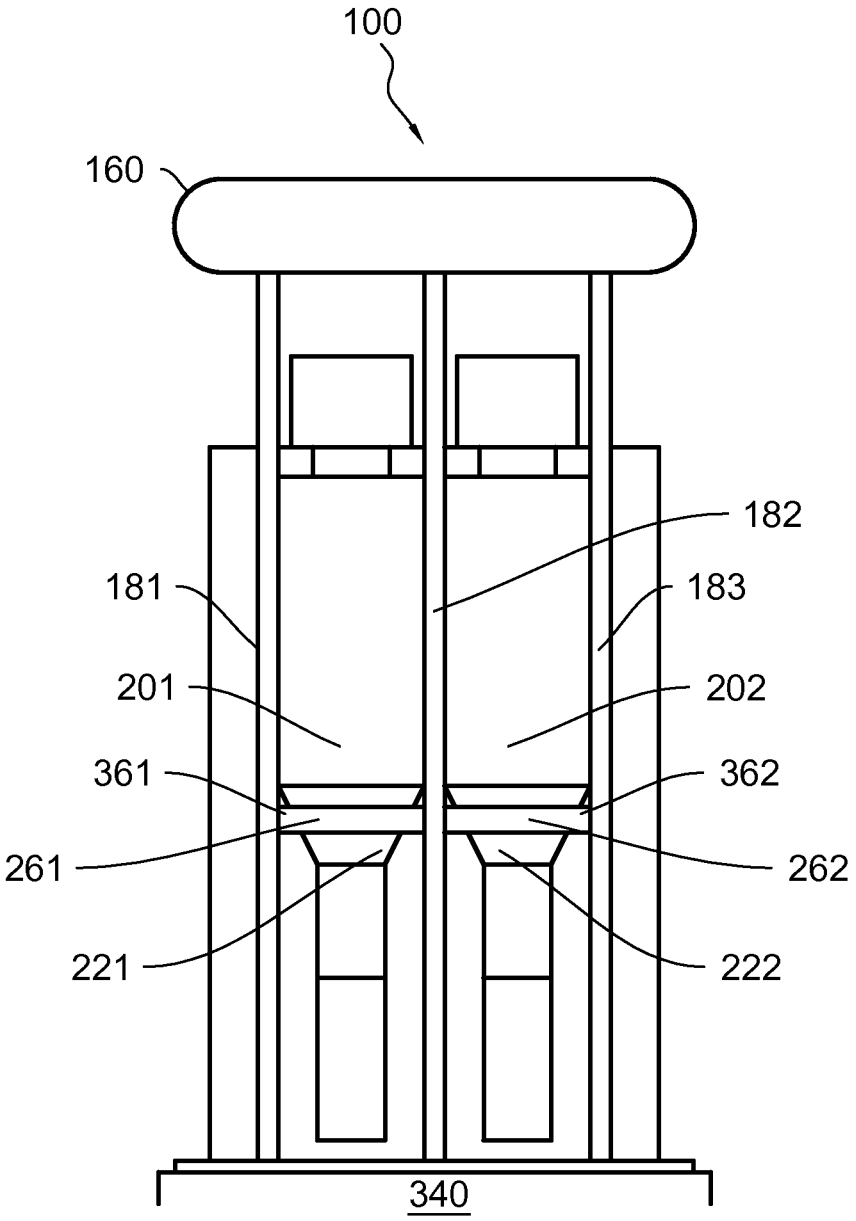
FIG. 6 schematically illustrates a sectional rear view of a fluidized bed boiler with a supporting construction for two particle separators.

FIG. 6 schematically shows a rear view of a fluidized bed boiler 100 having two particle separators 201 and 202. The first particle separator 201 has a conical lower portion 221 resting on a first supporting member 261, and the second particle separator 202 has a conical lower portion 222 resting on a second supporting member 262. An outboard portion 361 of the first supporting member 261 is connected to a first downcomer pipe 181 and a second downcomer pipe 182. Similarly, an outboard portion 362 of the second supporting member 262 is connected to the second downcomer pipe 182 and a third downcomer pipe 183. Therefore, the supporting members 261 and 262 share the second downcomer pipe 182 as an attaching location. The supporting members 261 and 262 are located at the horizontal level of the conical lower portions 221 and 222 of the particle separators 201 and 202, respectively. This provides a stable and rigid support for the particle separators 201 and 202.

A steam drum 160 is in flow communication with each of the first 181, second 182, and third downcomer pipes 183. The fluidized bed boiler 100 is located on a support foundation 340 and the downcomer pipes 181, 182, and 183 extend from the support foundation 340 to the steam drum 160. This provides a very stable construction without using heavy components or complex structures.

As becomes clear from above, a fluidized bed boiler with a simple and a reliable supporting construction of a particle separator is provided. The supporting construction is applicable in a number of various applications and purposes.

While the invention has been described herein by way of examples in connection with what are at present considered to be the most preferred embodiments, it is to be understood that the invention is not limited to the disclosed embodiments, but is intended to cover various combinations or modifications of its features and several other applications included within the scope of the invention as defined in the appended claims.

The invention claimed is:

1. A fluidized bed boiler with a support construction for a particle separator, the fluidized bed boiler comprising:

a bottom-supported furnace;

at least one particle separator with a support construction in gas flow connection with an upper portion of the furnace and comprising a furnace side portion, an outer portion opposite to the furnace side portion, and a conical lower portion; and at least two bottom-supported downcomer pipes in fluid connection with a steam drum and adjacent to the outer portion of the particle separator, wherein the support construction comprises a frame-like supporting member surrounding at least a portion of the conical lower portion, an outboard portion of the supporting member is attached to the at least two downcomer pipes to support the at last one particle separator, and an inboard portion of the supporting member is attached to a side wall of the furnace to support the at least one particle separator.

2. A fluidized bed boiler in accordance with claim 1, wherein the supporting member is attached to the at least two downcomer pipes at the horizontal level of the conical lower portion of the at least one particle separator.

3. A fluidized bed boiler in accordance with claim 1, wherein a horizontal internal cross section of the frame-like supporting member corresponds to a horizontal external cross section of the conical lower portion of the at least one particle separator.

4. A fluidized bed boiler in accordance with claim 3, wherein the internal cross section is arranged in contact with the external cross section of the conical lower portion of the at least one particle separator.

5. A fluidized bed boiler in accordance with claim 1, wherein the frame-like supporting member has a horizontal internal cross section that is arranged in contact with only a portion of a horizontal external cross section of the conical lower portion of the at least one particle separator.

6. A fluidized bed boiler in accordance with claim 1, further comprising two particle separators and three downcomer pipes.

7. A fluidized bed boiler in accordance with claim 1, further comprising three particle separators and four downcomer pipes.

8. A fluidized bed boiler in accordance with claim 1, wherein the fluidized bed boiler is a circulating fluidized bed boiler.

9. A fluidized bed boiler in accordance with claim 1, wherein the fluidized bed boiler is a bubbling bed boiler.

10. A fluidized bed boiler with a support construction for a particle separator, the fluidized bed boiler comprising:

a bottom-supported furnace;

at least one particle separator with a support construction in gas flow connection with an upper portion of the furnace and comprising a furnace side portion, an outer portion opposite to the furnace side portion, and a conical lower portion; and at least two bottom-supported downcomer pipes in fluid connection with a steam drum and adjacent to the outer portion of the particle separator, wherein the support construction comprises a frame-like supporting member surrounding at least a portion of the conical lower portion, and an outboard portion of the supporting member is attached to the at least two downcomer pipes to support the at last one particle separator, and wherein each of the at least two bottom-supported downcomer pipes comprises a full height vertical downcomer pipe adjacent to the outer portion of the at least one particle separator and an additional branch of the downcomer pipe adjacent to the furnace side portion of the at least one particle separator, and the outboard portion of the supporting member is attached to the full height vertical downcomer pipes and the inboard portion of the supporting member is attached to the additional branches of the downcomer pipes.

11. A fluidized bed boiler in accordance with claim 10, wherein the weight of the at least one particle separator is carried by the full height downcomer pipes and the additional branches of the downcomer pipes.

12. A fluidized bed boiler in accordance with claim 11, wherein the inboard portion of the supporting member is attached to a sidewall of the furnace to prevent horizontal movements of the support construction.

13. A fluidized bed boiler with a support construction for a particle separator, the fluidized bed boiler comprising:

a bottom-supported furnace;

at least one particle separator with a support construction in gas flow connection with an upper portion of the furnace and comprising a furnace side portion, an outer portion opposite to the furnace side portion, and a conical lower portion; and at least two bottom-supported downcomer pipes in fluid connection with a steam drum and adjacent to the outer portion of the particle separator, wherein the support construction comprises a frame-like supporting member surrounding at least a portion of the conical lower portion, and an outboard portion of the supporting member is attached to the at least two downcomer pipes to support the at last one particle separator, and wherein each of the at least two bottom-supported downcomer pipes comprises a full height vertical downcomer pipe adjacent to the furnace side portion of the at least one particle separator and an additional branch of the downcomer pipe adjacent to the outer portion of the at least one particle separator, and the outboard portion of the supporting member is attached to the additional branches of the downcomer pipes and the inboard portion of the supporting member is attached to the full height vertical downcomer pipes.

14. A fluidized bed boiler with a support construction for a particle separator, the fluidized bed boiler comprising:

a bottom-supported furnace;

at least one particle separator with a support construction in gas flow connection with an upper portion of the furnace and comprising a furnace side portion, an outer portion opposite to the furnace side portion, and a conical lower portion; and at least two bottom-supported downcomer pipes in fluid connection with a steam drum and adjacent to the outer portion of the particle separator, wherein the support construction comprises a frame-like supporting member surrounding at least a portion of the conical lower portion, and an outboard portion of the supporting member is attached to the at least two downcomer pipes to support the at last one particle separator, and wherein a horizontal internal cross section of the frame-like supporting member corresponds to a horizontal external cross section of the conical lower portion of the at least one particle separator.

15. A fluidized bed boiler in accordance with claim 14, wherein the internal cross section is arranged in contact with the external cross section of the conical lower portion of the at least one particle separator.

16. A fluidized bed boiler with a support construction for a particle separator, the fluidized bed boiler comprising:

a bottom-supported furnace;

at least one particle separator with a support construction in gas flow connection with an upper portion of the furnace and comprising a furnace side portion, an outer portion opposite to the furnace side portion, and a conical lower portion; and at least two bottom-supported downcomer pipes in fluid connection with a steam drum and adjacent to the outer portion of the particle separator, wherein the support construction comprises a frame-like supporting member surrounding at least a portion of the conical lower portion, and an outboard portion of the supporting member is attached to the at least two downcomer pipes to support the at last one particle separator, and wherein the frame-like supporting member has a horizontal internal cross section that is arranged in contact with only a portion of a horizontal external cross section of the conical lower portion of the at least one particle separator.

* * * * *